United States Patent [19]

Schmid

[11] 3,988,023

[45] Oct. 26, 1976

[54] BOWLING BALL RETURN MECHANISM

[75] Inventor: August Schmid, Schwerzenbach, Switzerland

[73] Assignee: Patentverwertungs-und Finanzierungsgesellschaft SERANIA AG, Glarus, Switzerland

[22] Filed: June 23, 1975

[21] Appl. No.: 589,265

[30] Foreign Application Priority Data

June 27, 1974 Switzerland ..... 8826/74

[52] U.S. Cl. ..... 273/49

[51] Int. Cl.[2] ..... A63D 5/02

[58] Field of Search ..... 273/47, 49

[56] References Cited

UNITED STATES PATENTS

| | | | |
|---|---|---|---|
| 2,600,918 | 6/1952 | Pohl | 273/49 |
| 2,803,463 | 8/1957 | Congelli | 273/49 |
| 3,012,782 | 12/1961 | Larson | 273/49 |
| 3,085,801 | 4/1963 | Patterson et al. | 273/49 |
| 3,086,776 | 4/1963 | Zuercher | 273/49 |
| 3,501,147 | 3/1970 | Uecker | 273/49 |

*Primary Examiner*—Anton O. Oechsle
*Attorney, Agent, or Firm*—Flynn & Frishauf

[57] ABSTRACT

To permit installation of a bowling ball return chute between a pair of alleys, and prevent interference of bowling balls admitted from either adjacent alley to the chute, the alleys are formed with openings which are blocked by doors, the doors each including an interlock mechanism mutually engageable with the interlock mechanism of the other so that, upon opening of one door due to pressure of a ball thereagainst, the other door is locked and admission of a ball from the other alley is prevented. The ball is then moved on a rocker which deflects due to the weight of the ball, the deflecting movement being re-transmitted to the previously opened door to close the door, so that a ball from the other alley can then be admitted, the doors being easily opened by impingement of the balls thereagainst. The doors are held in locked position by a lock mechanism which is unlocked by a feeler located to be engaged only by bowling balls, and not by the smaller bowling pins, preferably over a timer mechanism which permits opening only a predetermined time after a bowling ball has been played so that tossed pins cannot inadvertently engage the feeler, and hence permit spurious opening of a door.

13 Claims, 7 Drawing Figures

BOWLING BALL RETURN MECHANISM

The present invention relates to automatic bowling alley equipment, and more particularly to bowling ball return apparatus to return bowling balls from a bowling alley pit, and especially to such apparatus in which bowling balls which can be accepted by the return transport mechanism are admitted, while bowling balls which cannot be accepted for return transport at any given time are prevented from entering the apparatus, and which also excludes the entry of stray bowling pins.

Apparatus to return bowling balls to a playing position have been proposed, which use a flap, trap door, or the like, which is deflectable when a bowling ball impinges thereagainst, so as to open a doorway for the bowling ball. Such apparatus is, however, comparatively complicated and requires a special motor drive. The operating speed of such apparatus is limited.

It is an object of the present invention to provide a bowling ball return apparatus having an improved interlocking mechanism to prevent opening thereof if a ball is already in a return transport position, which operates rapidly and which permits increased return transport speeds of the bowling ball.

SUBJECT MATTER OF THE PRESENT INVENTION

Briefly, two oppositely located doors are provided, one, each, oriented to permit ingress of a bowling ball from adjacent parallel bowling alleys. The doors are interlocked by mechanical interlock elements connected to each one of the doors and so arranged that if either door is deflected from a closed, rest position, the interlock elements of the deflecting door are moved by the deflecting door into an interfering position preventing opening of the other door, and holding the other door in locked position, so that only one ball can be admitted through the opening door to the return mechanism. Such an arrangement can be constructed in simple manner, is reliable in operation, and does not require a separate motor drive, since the kinetic energy of an impinging bowling ball will automatically open the respective door, the interlock preventing entry of a second ball to the return mechanism, and hence interference with proper return of the first admitted ball.

The invention will be described by way of example with reference to the accompanying drawings, wherein.

The apparatus of the present invention is used to return bowling balls 41 (FIG. 5) from a bowling pin pit over a return track, or return chute 11 to the bowling playing position, so that the bowling balls are again available to the players. It is customary to provide one such return mechanism for two laterally adjacent parallel bowling ball alleys. Since the bowling games played at adjacent alleys are independent of each other, it may occur that bowling balls from both alleys appear at the respective doors to the return mechanisms at the same time; simultaneous or very close return of two bowling balls over the return track 11 could cause interference of the balls with each other. It is therefore necessary to prevent admission of a bowling ball to the return track 11 if a door to the mechanism has already been opened by another ball.

Figure 1:
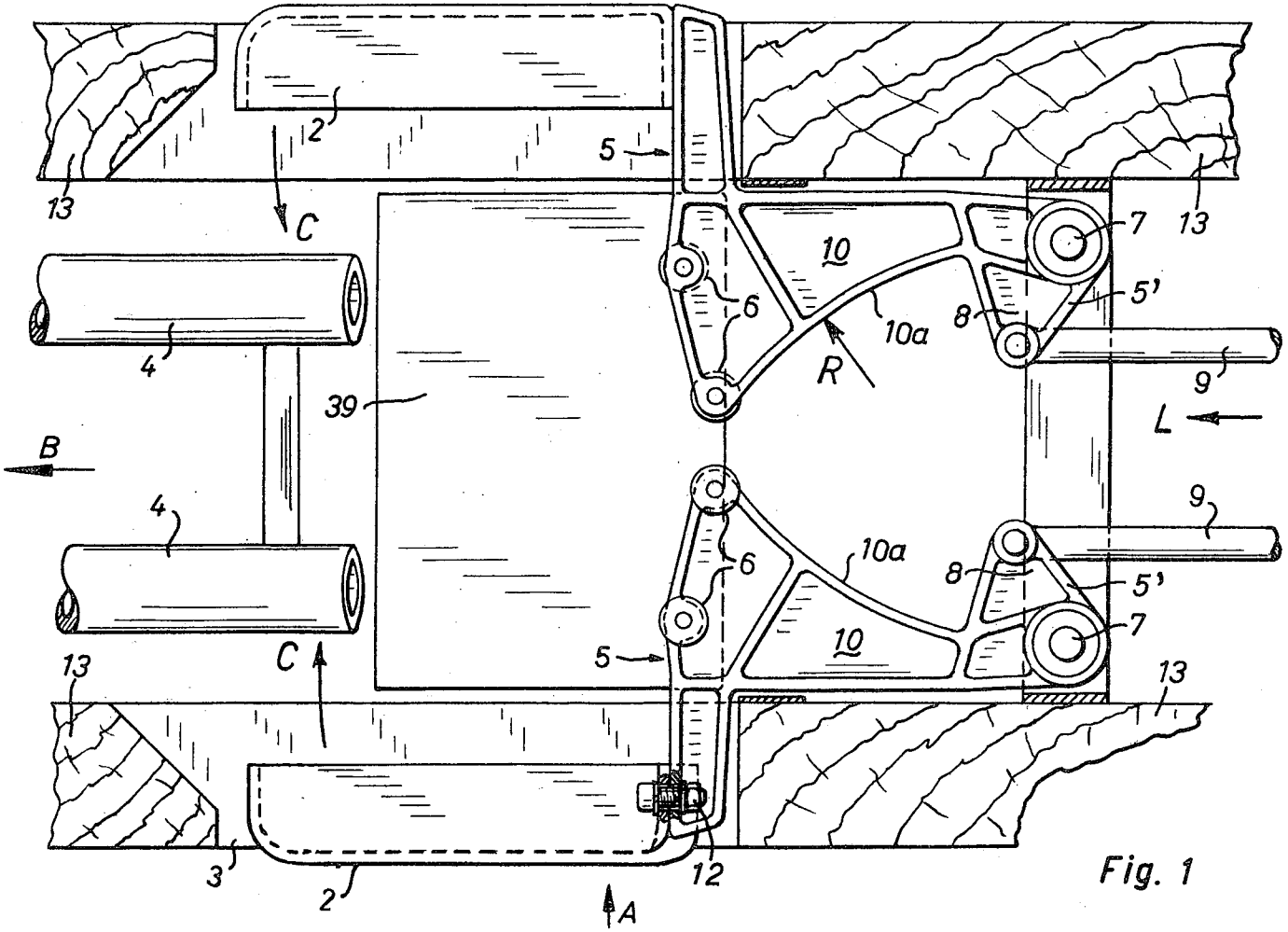
FIG. 1 is a schematic top view of a double acting bowling ball door mechanism to prevent admission of more than one bowling ball to a return apparatus, and showing both doors in closed position.
Figure 2:
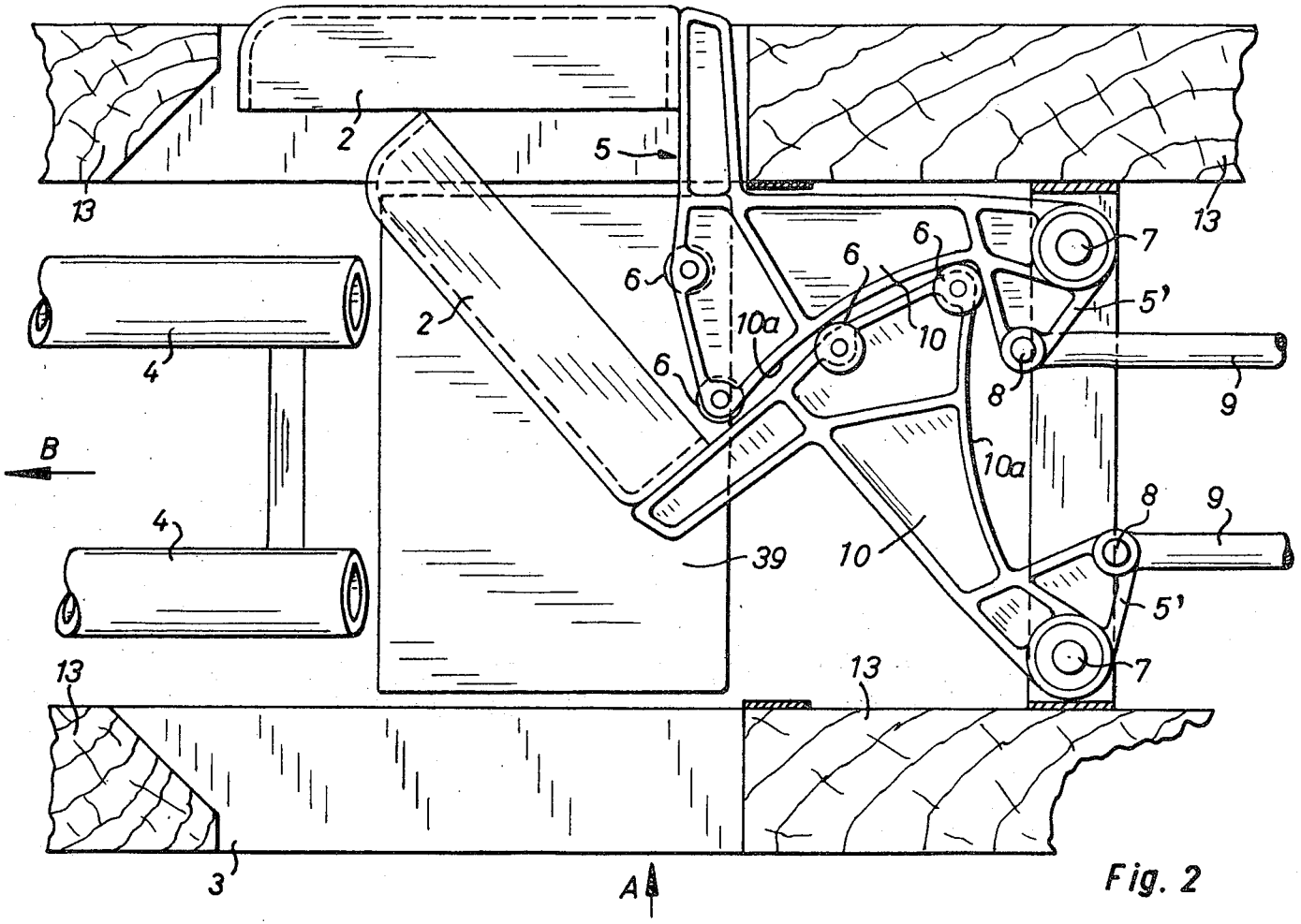
FIG. 2 is a top view similar to FIG. 1, in which one of the doors is open.
Figure 5:
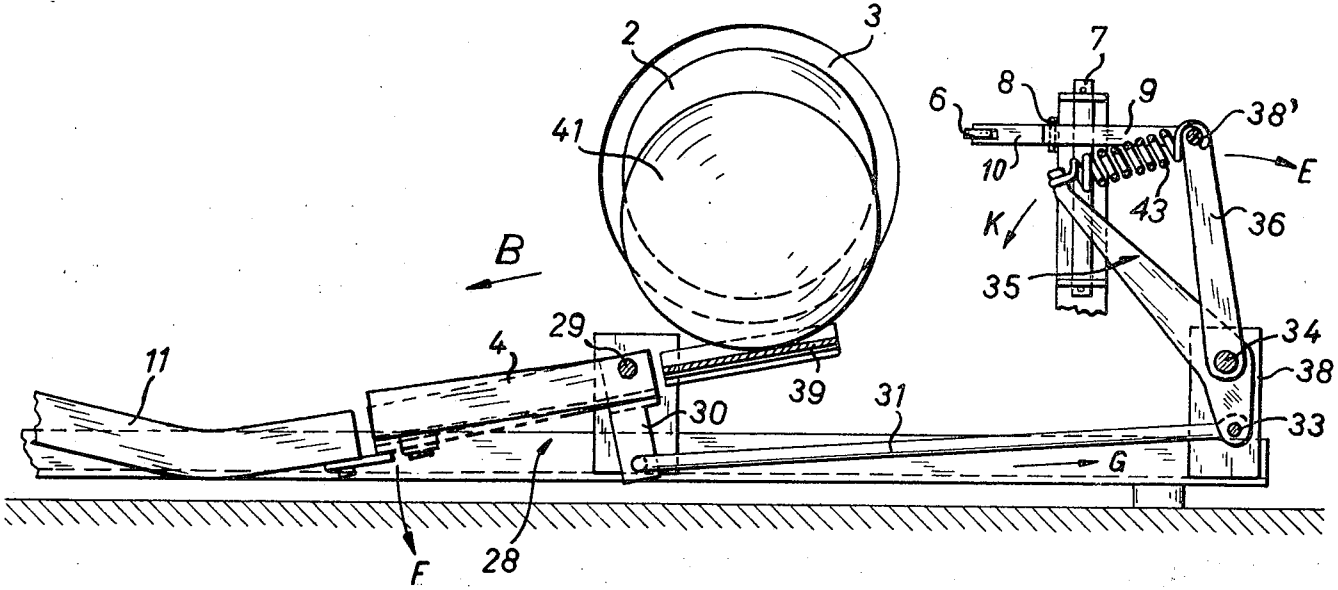
FIG. 5 is a vertical cross-sectional view of the bowling ball handling mechanism, illustrating the door reset mechanism.

Referring now to FIGS. 1 and 2: Two doors 2 are provided, one, each, facing a respective bowling alley. The doors are set into openings 3, 3 located in the lateral guide surfaces of the alleys, or the adjacent alley pit. The doors 2 can rotate about a vertical swing or pivot axis 7, 7. A bowling ball 41 (FIG. 5) which impinges against any one of the doors rolls unto an inclined plate 39 (FIGS. 1, 2 and 5), to be then located on a rocker mechanism 28 before reaching the actual return track 11. The return track 11 is preferably formed of two parallel bars or rods (FIGS. 1, 2 and 5) to guide the bowling balls thereon, and to support them along the run of the return track. The bowling balls are moved in their return run, at least initially, by means of a drive belt (not shown) and engaging a surface of the bowling ball, for example from the top or from the bottom thereof. After a ball 41 has passed through an opening 3, thus deflecting a respective door 2 in direction of the arrow C (FIG. 1), the ball then rolls in direction of arrow B; the ball is caused to roll on the track portions 4 in direction of arrow B (FIGS. 1, 2, 5).

Each one of the two doors 2 has an arm 5 secured thereto, for example by means of screws 12 (FIG. 1). Each one of the arms 5 has two rollers 6 mounted thereon; the rollers 6 have vertical axes of rotation, which are spaced by the same distance from the respective pivot axis 7 about which the respective door 2 may pivot. The two respective arms 5 are formed with an arcuate portion 10 which defines a curved track **10*a* for the rollers 6. Each one of the curved tracks 10*a* has a radial distance R from the vertical pivot axis 7 of the other door, when the door is closed. The distance R corresponds to the outer distance of the rollers 6 from the respective pivot axis 7.**

The respective arms 5, or rather the curved portion thereof, has an inwardly extending projection 5' in which a pivot axis 8 is located to which a rod 9 is pivotally connected.

Basic operation: Let it be assumed that the doors are in closed position, that is, are located as shown in FIG. 1. The adjacent rollers 6 of the doors are spaced from each other by only a small distance. As soon as one of the doors 2 is deflected only slightly in opening direction, the respective roller 6 will be moved in interfering position towards the track **10*a* of the arcuate member 10 of the other arm, thus preventing deflecting movement of the other arm. Thus, as soon as one door 2 opens (see FIG. 2), entry of a second ball through the other door is effectively prevented. Pressure or forces exerted by the other ball on the second door 2, that is, on the closed door, is accepted by the rollers 6, transferred to arm 5 and finally accepted by the respective pivot shaft 7.** The other door is thus locked in closed position and movement into open position is effectively prevented, even if strong forces are applied. The arms 5 are formed with reinforcement ribs and can be used alternately; only a single mold is necessary to make the arms, and for replacement or repair purposes, it is only necessary to stock one arm, since the arms are the mirror image of each other, reversed top for bottom.

Figure 3:
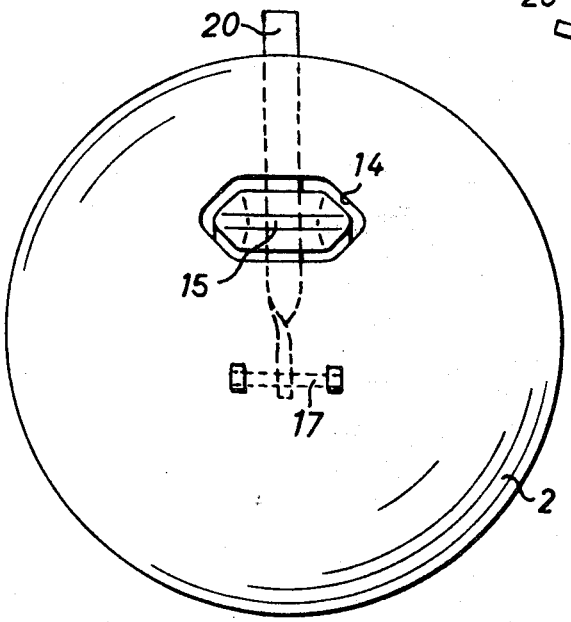
FIG. 3 is a view of the door looked at in the direction of arrow A in FIGS. 1 and 2.
Figure 4:
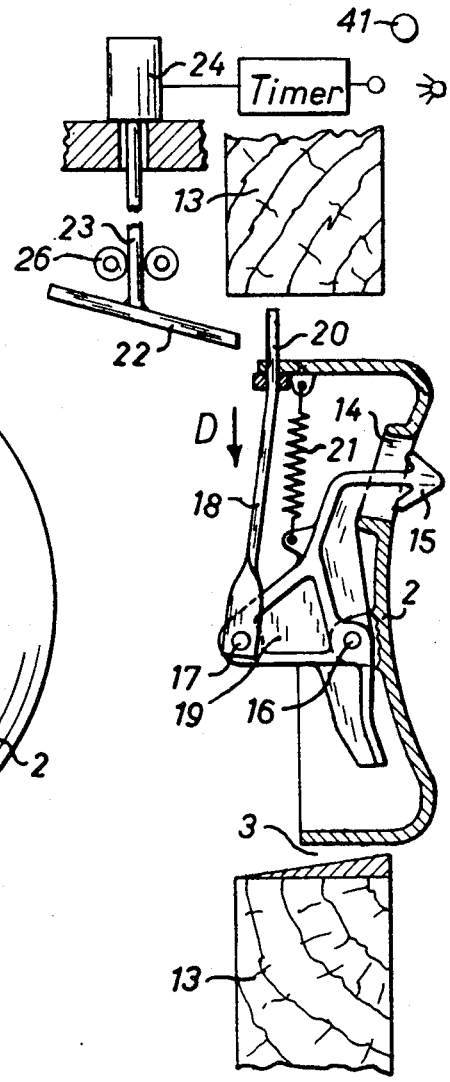
FIG. 4 is a vertical cross-sectional view through a door.

Entry of bowling pins should be prevented. It is thus necessary to prevent opening of a door 2 if a bowling pin impinges against the respective door, rather than a bowling ball. The additional locking mechanism of FIGS. 3 and 4 prevents opening of a door 2 unless a bowling ball impinges thereon.

A sensing element or feeler 15 is located in the upper third of the respective door 2. Feeler 15 is retained in the rest position shown in FIG. 4 by means of a weak spring 21. Feeler 15 is rotatable about a horizontal bolt 16, located at the inside of the door 2. The feeler 15 is connected to a horizontally projecting arm 19 which is linked by means of a pin 17 to an upwardly extending rod 18. Rod 18 is slidably guided in the upper portion of the door 2, for example in a horizontally extending edge projection 20 formed on the door itself. An inclined locking finger 22 is secured to a vertically movable rod 23, located in the path which the door must take when it is moved to opening position. Rod 23 is guided for vertical sliding movement by lateral guide rollers 26. It is connected to an electromagnet 24 which determines the vertical position of the finger 22 in dependence on the state of energization of the magnet 24.

Feeler 15 in the door 2 is so located with respect to the bottom of the bowling alley pit that it extends above the greatest width of any bowling pin. If, however, a ball with its much greater diameter rolls against the door, the feeler 15 is deflected inwardly, which causes dropping of rod 18 in the direction of arrow D, and thus lowers the rod 18 below the locking finger 22. The door 2 can therefore swing inwardly. The electromagnet arrangement 24, although not completely necessary, is desirable to prevent randomly tossed bowling pins from erroneously operating the feeler 15. If, for example, a bowling pin is tossed against feeler 15 so that it moves in opening direction (and, also, due to the kinetic energy, tends to open the door), finger 22 is moved downwardly into interfering position with rod 18 even if the rod 18 is dropped. This movement of finger 22 is limited in time. During the time of operation of the magnet 24, however, that is, when the finger 22 has moved to an extreme downward position, rod 18 will continue to impinge finger 22, although the feeler 15 has sensed the presence of something and thus has at least partially lowered rod 18. The delay time is so selected that it terminates when the bowling pins are no longer tossed, and are on their support surfaces and in the bowling pin pit, that is, when their position has quieted. At that time, a ball 41 which rolls against the door can open the door 2 by operating feeler 15 and hence dropping rod 18 to a position where there will be no interference with finger 22.

Alternatively, of course, the relative movement between rod 18 and finger 22 can be reversed.

The energization time of magnet 24 can be determined by a light gate, or light bar, shining a beam of light across the bowling alley, which beam of light is interrupted when the ball passes therethrough. The beam, shining on a photo detector such as a photo diode, photo transistor, or the like, is preferably located just in advance of the bowling pin positions, to start the timing period during which the magnet 24 places the finger 22 in interfering position to prevent opening of the respective door 2 upon impingement of an object thereagainst, regardless of operation of the feeler 15. Thus, bowling pins which may be tossed due to the throw of the ball and momentarily depress feeler 15 while impinging against the door 2 cannot cause opening of the door. After the time period has elapsed, the magnet 24 returns to rest position, so that a subsequently arriving ball can operate the feeler 15 and thus permit opening of the door 2 by impingement thereagainst, although bowling pins which might be moved against the door, for example by the bowling ball pushing a pin thereagainst, will not cause opening of the door due to the position of feeler 15 on the door itself. A suitable gating arrangement, which may also be pressure-operated, is described in application Ser. No. 535,698 filed Dec. 23, 1974, by the inventor hereof.

Closing movement, or reset of the doors 2, after having been opened, is effected by the force exerted on rocker mechanism 28 due to the weight of a bowling ball on the inclined track 4 (FIG. 5). The rocker mechanism 28 is pivotally mounted to tip about a horizontal axis 29, suitably secured on a base frame. The initial track portions 4 are secured to a depending arm 30 to which, in turn, an elongated link 31 is pivoted which, at the other end, is pivoted at 33 to an offset double-armed lever 35. Lever 35 is horizontally pivoted to rock about a shaft 34. Shaft 34 is secured in a bearing and support 38.

Figure 6:
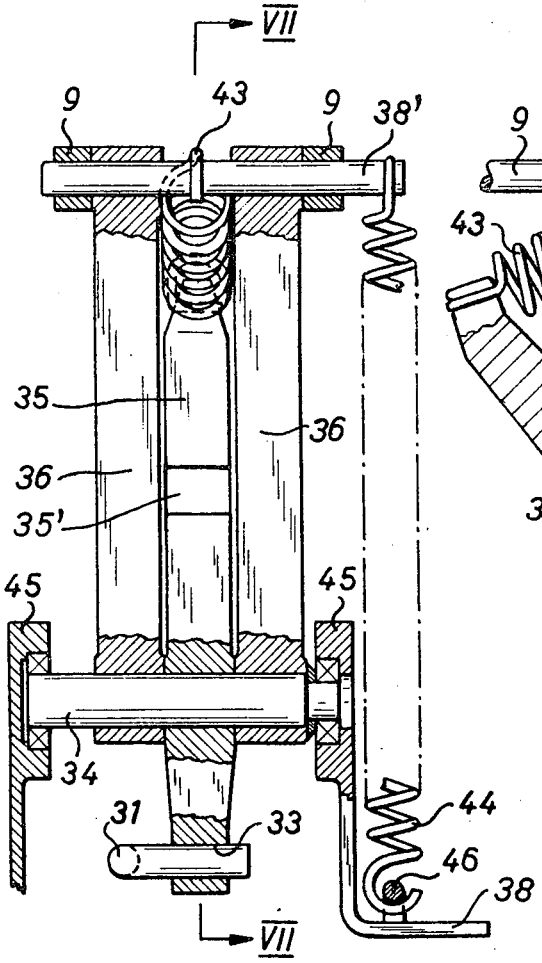
FIG. 6 is a detail view of the door reset mechanism.
Figure 7:
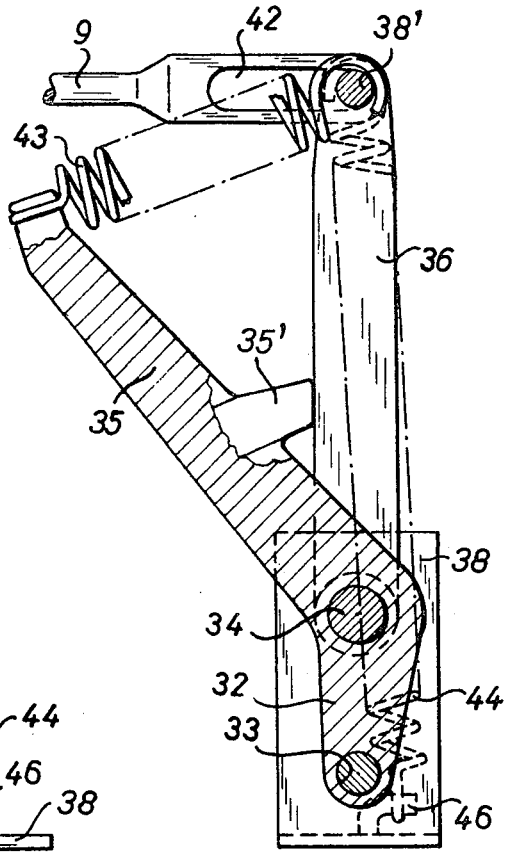
FIG. 7 is a sectional view along line VII—VII of FIG. 6.

Lever 35 is offset and, at its upper end, forms a bearing connection with a tension spring 43. The other end of spring 43 is connected to a guide lever 36, loosely pivoted on shaft 34. FIGS. 6 and 7 show the arrangement in greater detail; two parallel arranged arms 36 are provided, between which the lever 35 and spring 43 are located. A cross pin 38' connects the two levers 36, as well as spring 43. The two rods 9 are pivoted to cross pin 38' at either side of the link 36. The rods 9 (FIG. 1) are connected to the arms 5 which, in turn, are connected to the doors. Each one of the rods 9 is formed with a horizontal, longitudinal slit 42 in the region of engagement with the bolt 38'. The length of the slit is so selected that the bolt 38 can have a path of lost motion with respect to the one, or the other, of the rods 9 upon movement of the rocker 28, or of one of the doors 2, respectively.

Door closing, or door reset operation: A ball 41 which rolls onto rocker 28 causes depression of the track portion 4, and hence movement of that track portion in the direction of the arrow F (FIG. 5). As a result of such movement, arm 30 and hence rod 31 are moved, rod 31 pushing rearwardly in the direction of arrow G (FIG. 5). Lever 35 thus pivots in direction of arrow K pulling rod 38' by means of spring 43 which, in turn, causes movement of the respective rod 9 in the direction of the arrow L (FIG. 1) and thus causes closing of the respective door 2. Spring 43 acts as a resilient intermediate element to prevent damage if, due to some external reason, closing movement of the respective door 2 should be impeded.

A further spring 44 is provided, extending approximately vertically and having an effective force vector closely adjacent to the position of shaft 34 (see FIG. 7) and in the rear thereof. It provides a reset force for track portion 4 after the ball has rolled of the rocker mechanism 28 and unto return track 11 by pulling lever 35 counter the direction of arrow K (FIG. 5). The bearing support 38 is preferably a plane bracket (see FIGS. 6, 7) with a punched-out hook 46 into which spring 44 can be hooked. The upper portion of the bracket 38 is enlarged, as seen at 45, to hold the bearings for shaft 34. Lever 35 is formed with an intermediate projection 35', to reliably guide the lever 35 between the two links 36.

The structure does not require any motor drive to operate the doors, or to reset the doors, since the weight of the bowling ball, acting on the rocker, is used to effect reset, or closing operation of the doors 2. Only little force is necessary to open the doors 2, so that balls 41 can be rapidly returned, and rapid return movement of the balls is not impeded.

The lever 35 and link 36 can be replaced by a single lever which connects bolts 33 and 38', and which is pivoted on the shaft 34. The rods 9 are connected to bolt 38' as before by means of the lost motion slit 42.

Various changes and modifications may be made within the scope of the inventive concept.

I claim:

1. Bowling ball return mechanism to return bowling balls (41) from adjacent bowling alleys located at either side of said mechanism, said adjacently located alleys having openings (3) to admit bowling balls (41) to the mechanism, wherein said mechanism comprises respective oppositely located doors (2) blocking access through the openings (3) and pivotally mounted to pivot about essentially parallel pivot axes (7); and mutually interlocking means (5, 6, 10) connected to each said doors and movable therewith upon opening movement of either door, movement of either door (2) and with it the associated interlocking means effecting placement of the respective interlocking means into interfering position with the interlocking means of the other door to block opening of the other door when one of said doors has opened, comprising a projecting arm (5) coupled to the respective door, said arm having an arcuate surface (10*a*) having a center point congruent with the pivot axis (7) of the other door;

the arm on each door having engagement means (6) engageable with the arcuate surface of the other door upon pivoting movement of the respective door about its pivot axis.

2. Mechanism according to claim 1, wherein the engagement means comprises rollers (6) having an outer surface located at a distance from the pivot axis (7) of the said door which corresponds to the radius of the arcuate surface (10*a*) of said other door.

3. Mechanism according to claim 1, further comprising a rocker mechanism (28) located between said doors beneath the opening thereof to receive a bowling ball (41) admitted through a respective door;

and connection link means (30, 31, 35, 36, 9) connecting said rocker mechanism and said doors to move the doors to closing position upon rocking of said rocker mechanism, said rocker mechanism being rocked upon placement of a weight corresponding to the weight of the bowling balls (41) thereon.

4. Mechanism according to claim 3, wherein the rocker mechanism comprises a ball-receiving surface (4), an essentially horizontally extending rocking shaft (29) forming a fulcrum for said ball-receiving surface;

and wherein the connection link means comprises connecting links and levers (30, 31, 35, 9), at least one of said levers having a lost-motion connection.

5. Mechanism according to claim 3, wherein said connection link means comprises a resilient link connection (35, 36, 43).

6. Mechanism according to claim 1, further comprising a bowling ball feeler (15) located in each one of the doors (2) at a height higher than the greatest diameter of a bowling pin, but less than the diameter of a bowling ball, said feeler being movably mounted and changing position with respect to the door upon sensing the presence of a ball adjacent the door.

7. Mechanism according to claim 6, further comprising door locking means (18, 20, 22) operatively connected to said feeler (15), said locking means being in locked position when said feeler is in rest position, said locking means being moved to unlocked position upon presence of a ball adjacent the door (2) as sensed by the feeler.

8. Mechanism according to claim 7, further comprising electrically operated means (24) inhibiting movement of said locking means to unlocked position even if said feeler senses presence of an object adjacent the door;

and time delay means operating said electrically operated means for a period of time after passage of the bowling ball through a sensing position of the bowling alley to prevent stray opening of the door by tossed bowling pins immediately subsequent to passage of a ball against the pins, and before the pins have come to rest in the pin pit of the bowling alley.

9. Mechanism according to claim 1, wherein the doors are pivotally mounted to swing about an essentially vertical pivot axis (7);

a rocker mechanism located between said doors in position to receive a bowling ball, and to pivot about its rocking axis due to the weight of the bowling ball;

link means connecting the rocker mechanism to the door to reset the door to closing position upon movement of the rocker mechanism due to the weight of a ball present between the doors, whereby the doors will be closed by positive movement due to the weight of a ball present between the doors;

door locking means (18, 20, 22) retaining said doors (2) in closed, locked position;

and sensing means (15) connected to the door locking means, sensing pressure of a ball (41) adjacent the door and moving said door locking means to unlocked position, whereby movement of the doors between open and closed position is solely controlled by the balls.

10. Bowling ball return mechanism to return bowling balls (41) from adjacent bowling alleys located at either side of said mechanism, said adjacently located alleys having openings (3) to admit bowling balls (41) to the mechanism, wherein said mechanism comprises respective oppositely located doors (2) blocking access through the openings (3);

mutually interlocking means (5, 6, 10) connected to each said doors and movable therewith upon opening movement of either door, movement of either door (2) and with it the associated interlocking means effecting placement of the respective interlocking means into interfering position with the interlocking means of the other door to block opening of the other door when one of said doors has opened;

a rocker mechanism (28) comprising a ball receiving surface (4) and an essentially horizontally extending rocking shaft 29 forming a fulcrum for said ball receiving surface, located between said doors (2) beneath the opening thereof to receive a bowling ball (41) thereon admitted through a respective door, the ball receiving surface (4) deflecting under the weight of the ball;

and connection link means (30, 31, 35, 36, 9) directly mechanically connecting said rocker mechanism (28) and said doors (2) to move the doors to closing position upon rocking of said rocker mechanism due to placement of the weight of a bowling ball (41) thereon.

11. Mechanism according to claim 10, wherein the connection link means comprises connecting links and levers (30, 31, 35, 9), at least one of said levers having a lost motion connection.

12. Mechanism according to claim 10, wherein said connection link means comprises a resilient link connection (35, 36, 43).

13. Mechanism according to claim 10, further comprising reset spring means (44) connected to said rocker mechanism (28) and maintaining said rocker mechanism in a first, predetermined position buy permitting deflection of said rocker mechanism under the weight of a bowling ball (41) on the ball receiving surface (4).

* * * * *